US006722940B1

(12) United States Patent
Weikel

(10) Patent No.: US 6,722,940 B1
(45) Date of Patent: Apr. 20, 2004

(54) TORSION SPRING POWERED TOY VEHICLE

(75) Inventor: Curtis E. Weikel, 2855 Shelter Hill Dr., Fairfield, CA (US) 94534

(73) Assignee: Curtis E. Weikel, Fairfield, CA (US)

( * ) Notice: Subject to any disclaimer, the term of this patent is extended or adjusted under 35 U.S.C. 154(b) by 0 days.

(21) Appl. No.: 10/328,991

(22) Filed: Dec. 26, 2002

(51) Int. Cl.[7] ..... A63J 23/00
(52) U.S. Cl. ..... 446/464; 434/300
(58) Field of Search ..... 446/427, 448, 446/450, 451, 453, 457, 464; 434/300, 302

(56) References Cited

U.S. PATENT DOCUMENTS 2,570,711 A * 10/1951 Rempel ..... 446/464
3,323,229 A * 6/1967 Mulka ..... 434/302
3,619,939 A * 11/1971 Vidal ..... 446/464
4,817,936 A * 4/1989 Matsuda ..... 446/310

* cited by examiner

*Primary Examiner*—Jacob K. Ackun

(57) ABSTRACT

Torsion Spring Powered Toy Vehicle comprised of a chassis, a torsion spring assembly attached to the top side of the chassis, the torsion spring assembly consisting of a flat plate having a pair of centrally located perpendicular tabs, a torsion spring and an integral spring axle and lever arm retaining post a front and rear axle and attached wheels. The rear axle has a centrally located string receiving pin mounted to the axle so that when the user forces back the lever arm and attaches the string loop to the axle pin and turns the rear wheel set counter clockwise thereby winding the string about the rear axle and then releases the vehicle, the vehicle is propelled forward when the the torsion spring forces the lever arm to return to a rest position thereby causing the string to unwind thereby causing the rear wheels to rotate in a clockwise fashion.

7 Claims, 6 Drawing Sheets

Application No.
10/328,991

TORSION SPRING POWERED TOY VEHICLE

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of toy vehicles and more specifically to a torsion spring powered toy vehicle.

When teaching children about principles of physics and the formulas resulting from those principles, it has been proven to be helpful to provide various physical apparatus to demonstrate the real world effects of the principles in question and to see, in real life, the application of the applicable formulas.

One such basic formula is—Force equals mass times acceleration. To physically demonstrate this formula, science teachers have used a toy vehicle concept manufactured by such companies as Pitsco of Pittsburgh, Kans. The toy vehicle is comprised of a mouse trap having a torsion spring, a lever arm attached to one end of the spring and a means of wrapping the string around the rear axle of the vehicle so that when the string is wound up on the axle and the lever arm is released, the vehicle shoots forward demonstrating the principle—Force equals mass times acceleration. Although this toy is helpful in showing the principle, it is deficient in that the toy vehicle kit comes with only one diameter of wheel and one length of lever arm. Therefore it is not possible to evaluate and test the effect of different diameter wheels and different length lever arms. Additionally, the current vehicles do not have the ability to adjust the location of the torsion spring assembly fore and aft on the chassis. Additionally, the existing toys are built in a flimsy fashion and are not suitable for use in a classroom year after year thereby causing the school additional expense each year. Additionally, the existing toys do not provide a convenient method to increase or decrease the mass of the vehicle. Furthermore, the existing vehicles do not provide a way to change the degree of friction provided by the wheels. Finally, the existing vehicles are not particularly easy to assemble and disassemble.

BRIEF SUMMARY OF THE INVENTION

The primary object of the invention is to provide a torsion spring powered toy vehicle that can help the user learn about force, mass and acceleration.

Another object of the invention is to provide a torsion spring powered toy vehicle that can be easily assembled and disassembled by a child.

Another object of the invention is to provide a torsion spring powered toy vehicle that allows the user to use a variety of wheel sizes and lever sizes and weights to test the difference in distance and acceleration when various sizes are used.

Another object of the invention is to allow the user to adjust the location of the torsion spring fore and aft on the chassis.

A further object of the invention is to provide a torsion spring powered toy vehicle that allows the user to make changes to wheel size, lever size and weight quickly and easily.

Yet another object of the invention is to allow a child to gain first hand experience with the the physical equation—Force Equals Mass times Acceleration.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed Torsion Spring Powered Toy Vehicle comprising: a toy vehicle chassis, a torsion spring assembly attached to the top side of said chassis, said torsion spring assembly consisting of a flat plate having a pair of centrally located perpendicular tabs. A torsion spring and an integral spring axle and lever arm retaining post are attached through apertures in said tabs. A live rear axle is attached transversely to the rear of said chassis, said rear axle having a centrally located string receiving pin mounted in a perpendicular fashion to said axle. A live front axle is attached transversely to the front of said chassis. A plurality of sets of rear wheels are included, each set of wheels having a different diameter and capable of being removably attached to the rear axle. A set of front wheels is attached on either side of the front of said chassis. A tubular rigid lever arm is removably attached to the lever arm retaining post. The toy vehicle includes a plurality of lengths of said lever arm. A string is fixedly attached to each said lever arm and terminates in a loop. The loop can be attached to the rear axle pin. When the lever arm is pulled back and the string wound on the rear axle, a propulsion means is created so that when the user lets go of the lever arm, the vehicle is propelled forward. A post mounted perpendicularly to the chassis is capable of removably receiving a weighted washer or washers. Post 42 can be mounted forward or aft in additional holes 32, 34, 36 provided to change the downward force on the rear wheels 2,4 which affects traction. A plurality of apertures located in the top surface of the chassis allows the torsions spring assembly to be moved fore and aft and re-attached by fasteners such as bolts and nuts.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms.

Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
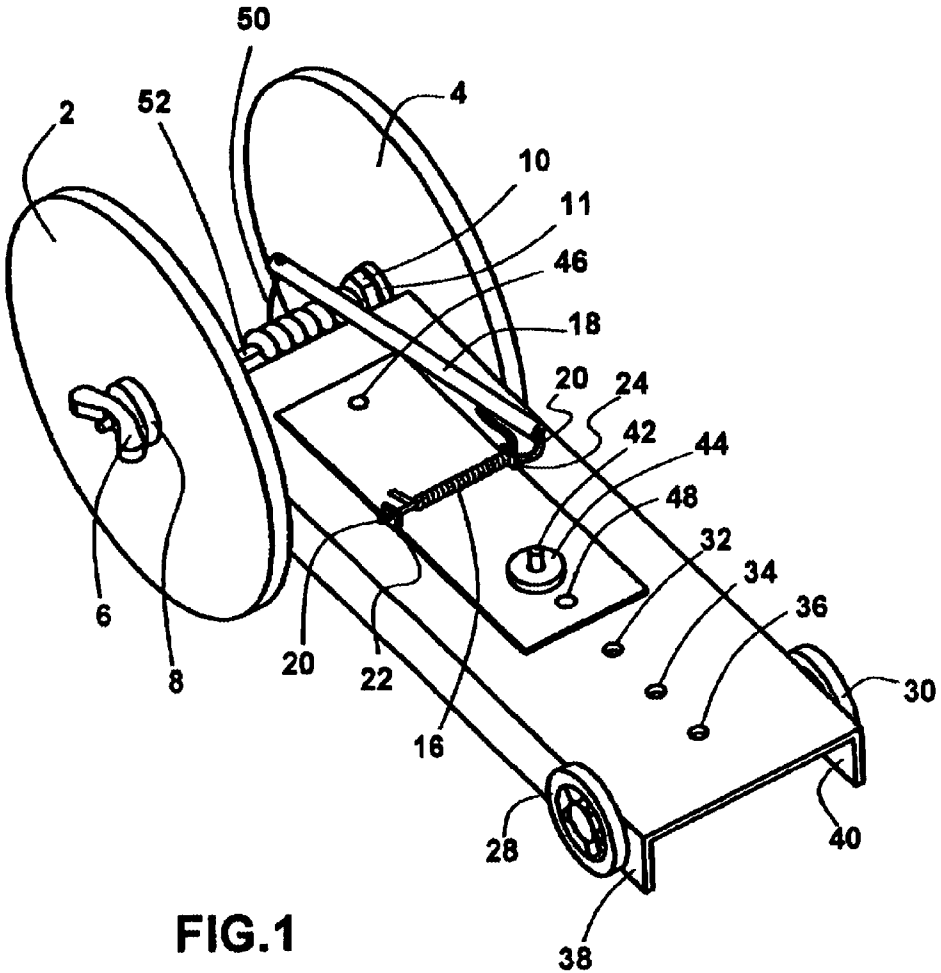
FIG. 1 is a perspective view of the invention.
Figure 2:
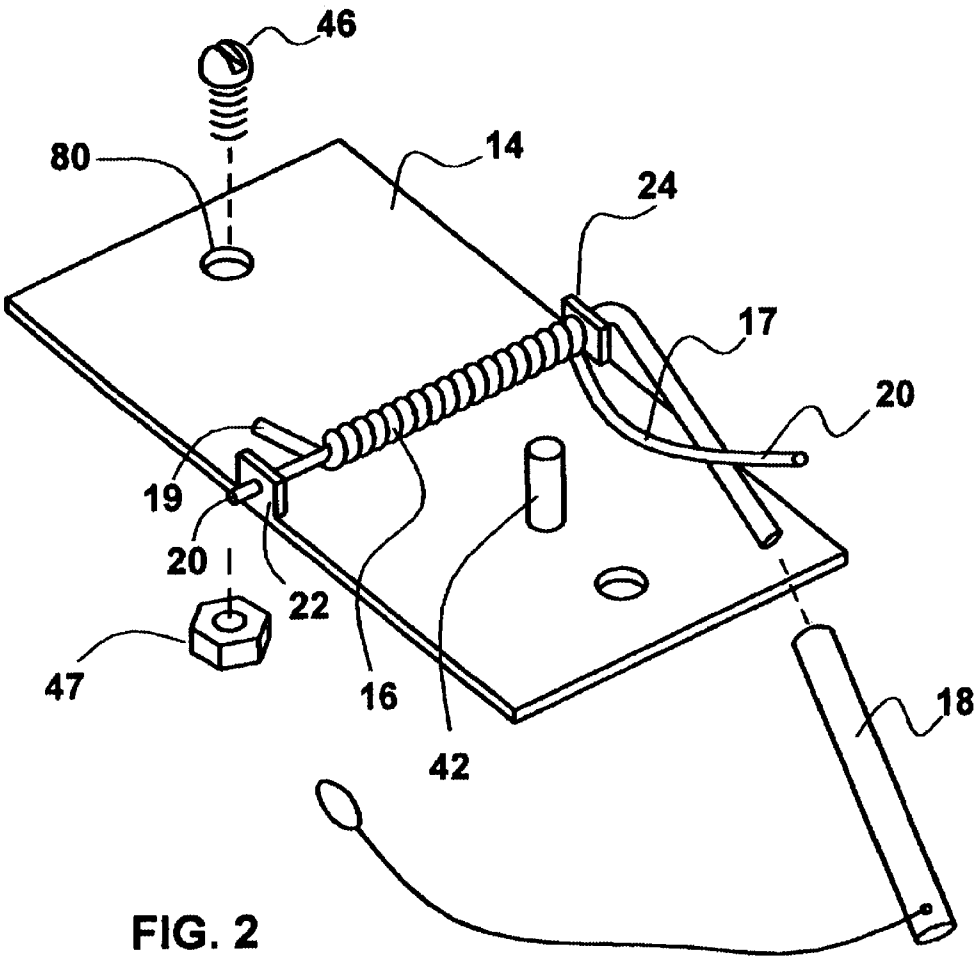
FIG. 2 is a perspective view of the torsion spring assembly of the invention.
Figure 3:
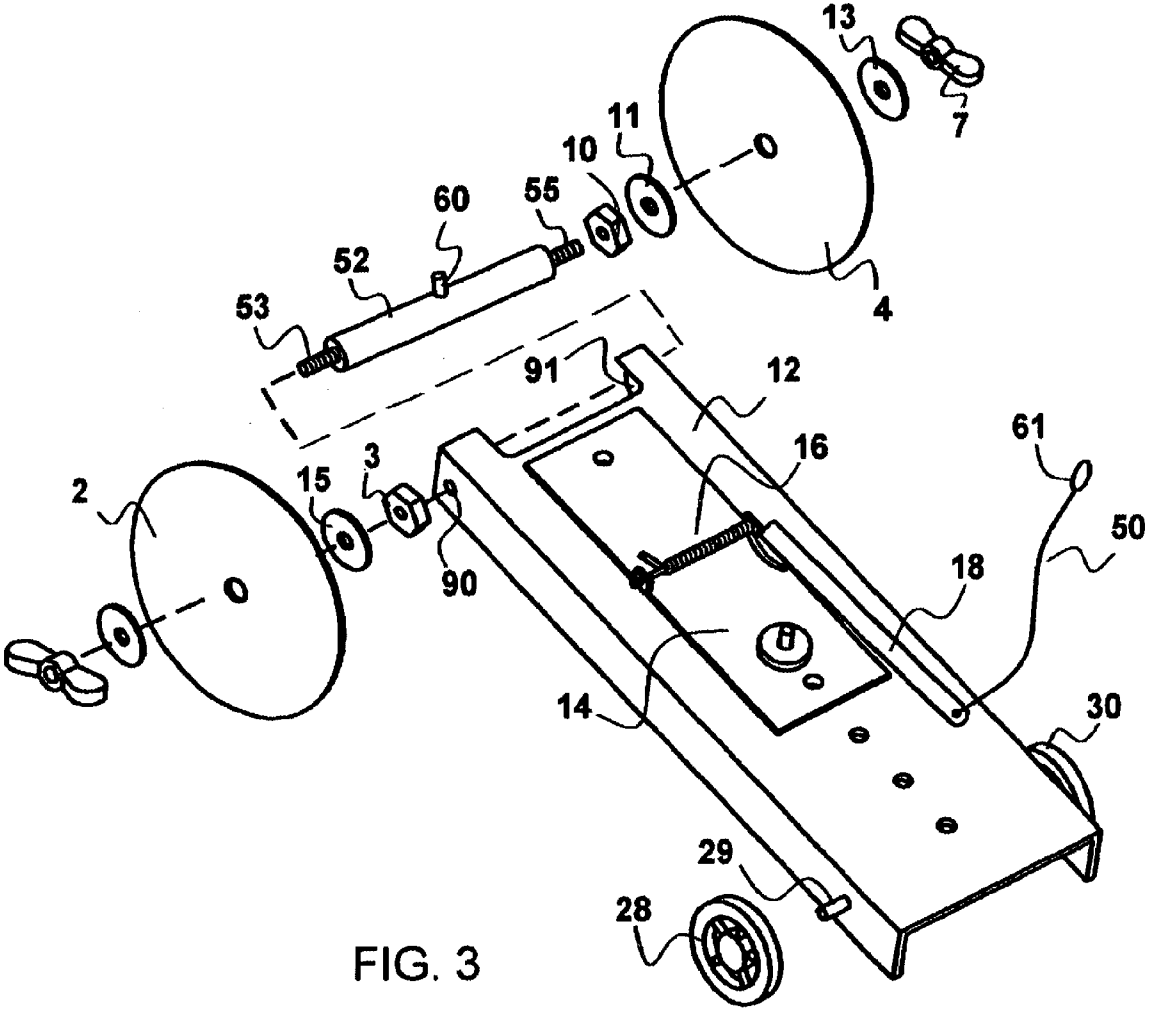
FIG. 3 is an exploded view of the invention.

Referring now to FIG. 1 we see a perspective view of the toy vehicle of the present invention 100. Rear wheels 2, 4, are held on to axle 53 by wing nut 6 separated from wheel 2 by washer 8. A torsion spring assembly consist of torsion spring 16, mounting plate 14 having perpendicular tabs 22, 24, a spring axle and integral lever arm holding post 20. Lever arm 18 is slid onto post 20. A string 50 is fixedly attached to the end of lever arm 18 and the free end terminates in a loop that attaches to a pin located on axle 52 and the string is wound about the axle 52 by the user. When the user lets go of lever arm 18 it moves about arc 26 to its resting place on chassis 12 thereby causing string 50 to be pulled and forcing axle 52 and attached rear wheels 2, 4 to spin thereby propelling the toy vehicle 100 forward. Front wheels 28, 30 are mounted to the front of chassis 12 in the standard way. The spring plate 14 is attached to chassis 12 by bolts 46, 48. The user can choose to move the spring plate by loosening bolts 46, 48 and replacing them in one of the other apertures 32, 34, 36 provided. Post 42 allows the user to add a weight 44 to the vehicle thereby changing the mass. FIG. 2 shows a detailed view of the spring assembly. Torsion spring 16 terminates at one end in fixed end 19 and at the other end in rotatable end 17. End 17 is wrapped around lever arm retaining post 20. Post 20 acts as an axle for spring 16 and then bends approximately eighty degrees to form the ever arm retaining post. Rigid tubular lever arm 18 can be slid onto lever retaining post 20 and spring end 17 holds the lever arm 18 frictionally in place. Retaining bolt 46 can be clearly seen to penetrate through aperture 80 thereby fastening the plate 14 by nut 47 to chassis 12. FIG. 3 is an exploded view of the present invention 100. Spring holding tabs 22 and 24 hold post 20 more safely and securely than a traditional mouse trap device that is sometimes used in toys of this type.

Figure 4:
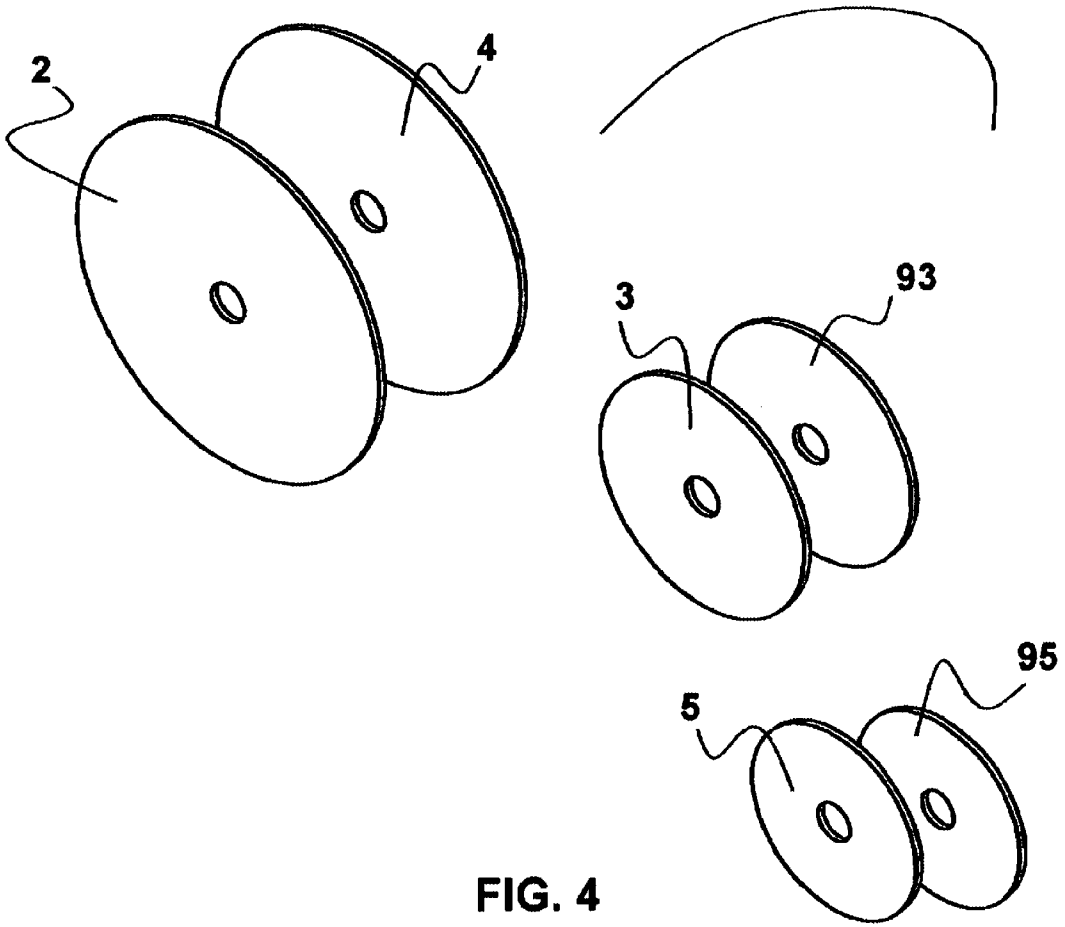
FIG. 4 is a view of the various rear wheel sizes of the invention.
Figure 5:
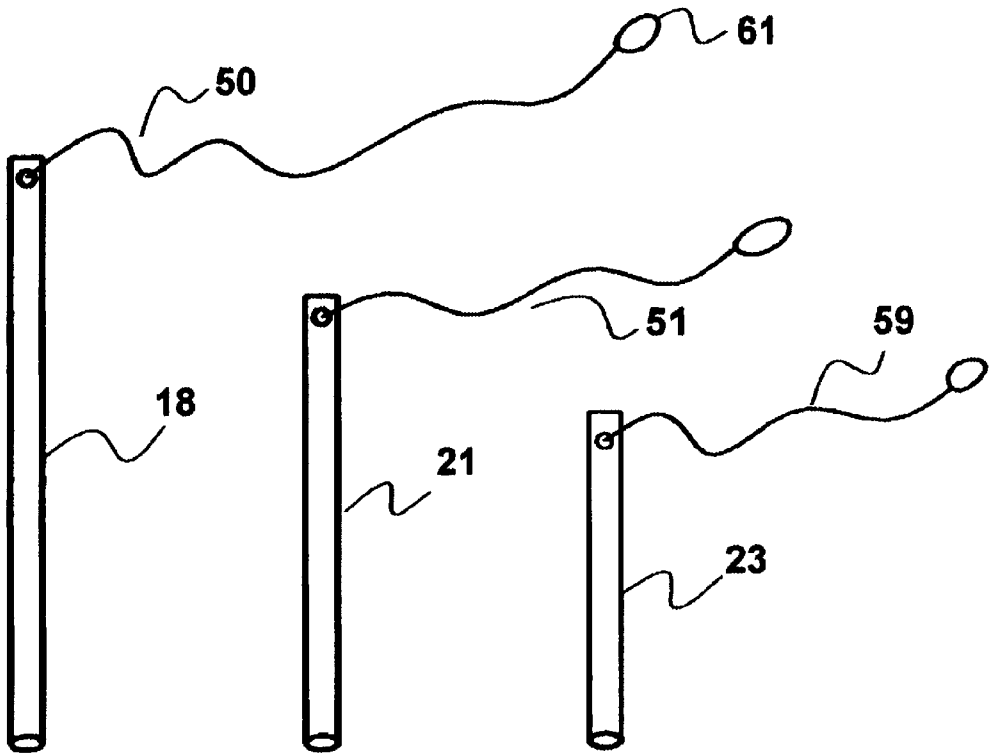
FIG. 5 is a view of the various lever arm sizes of the invention.
Figure 6:
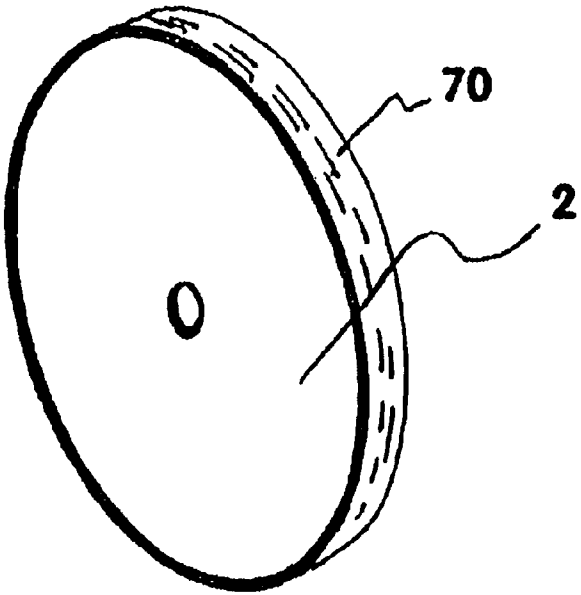
FIG. 6 is a perspective view of a rear wheel whit an added friction tire.

In this view perpendicular string retaining pin 60 can be clearly seen fixedly mounted to the central portion of live rear axle 52. The axle ends 52, 55 penetrate chassis apertures 90, 91 and accept washers 15, 11 and nuts 13. 10. Wheels 2, 4 are then slipped on and held in place by washers 8, 13 and wing nuts 6, 7. This allows the user to easily remove the wheels 2, 4 without the need of tools. Live front axle 29 can be clearly seen ready to accept front wheels 28, 30. FIG. 4 shows how sets of rear wheels 2,4 3, 93, and 5, 95 can be provided to allow the user to test the results of speed and distance when different diameter wheels are used. FIG. 5 shows a plurality of lever arms 18, 21, 23, that can be placed on the lever arm receiving post 20 so that the user can change the duration of time of axle rotation as well as the force applied to the rear axle 52. FIG. 6 shows a rear wheel 2 with a rubber tire 70, in this case a rubber band, to increase the traction of the wheel 2 to the surface that the vehicle is rolling on.

The present invention also helps the user understand the principles of potential energy, kinetic energy, velocity, inertia and torque.

The above description and illustrations show that the present toy vehicle invention is a novel means to help children learn the effects of force, mass and acceleration and the relationship between these basic physical principles. The invention is easy and economical to manufacture and is easy for children to assemble and disassemble.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Torsion Spring Powered Toy Vehicle comprising:

a toy vehicle chassis;

a torsion spring assembly attached to the top side of said chassis;

said torsion spring assembly consisting of a flat plate having a pair of centrally located perpendicular tabs, a torsion spring and an integral spring axle and lever arm retaining post.

a live rear axle attached transversely to the rear of said chassis;

said rear axle having a centrally located string receiving pin mounted in a perpendicular fashion to said axle;

a live front axle attached transversely to the front of said chassis;

a plurality of sets of rear wheels;

each set of said rear wheels capable of being removably attached to said rear axle on either side of the rear of said chassis;

said sets of rear wheels provided in a plurality of different diameters;

a set of front wheels attached on either side of said front of said chassis;

a tubular rigid lever arm removably attached to said lever arm retaining post;

said toy vehicle including a plurality of lengths of said lever arm;

a string attached to each said lever arm;

said string terminating in a loop;

a post mounted perpendicularly to said chassis capable of removably receiving a weighted washer; and a set of weighted washers capable of being received by said post.

2. Torsion Spring Powered Toy Vehicle as claimed in claim 1 wherein said lever arm is forced back by the user and the user attaches said string loop to said axle pin and turns said rear wheel set counter clockwise thereby winding said string about said rear axle and then releases said vehicle, said vehicle is propelled forward when the said torsion spring forces said lever arm to return to a rest position thereby causing said string to unwind thereby causing said rear wheels to rotate in a clockwise fashion.

3. Torsion Spring Powered Toy Vehicle as claimed in claim 1 wherein said rear wheels are removably retained by a wing nut thereby making it easy for a child to change said rear wheels of different diameters without the need for tools.

4. Torsion Spring Powered Toy Vehicle as claimed in claim 1 wherein said lever arm is easily slid onto and removed from said lever arm receiving post.

5. Torsion Spring Powered Toy Vehicle as claimed in claim 1 further comprising a set of rubber or other high friction tire elements that can be removably attached to said rear wheels thereby giving said rear wheels more traction.

6. Torsion Spring Powered Toy Vehicle as claimed in claim 1 further comprising a book and or video that further teaches and demonstrates the use of the said vehicle to said user and further teaches the principles of the physics formula—Force equals mass times acceleration.

7. Torsion Spring Powered Toy Vehicle as claimed in claim 1 wherein said toy vehicle can be easily and economically manufactured.

* * * * *